United States Patent [19]

Derksen

[11] Patent Number: 4,749,105

[45] Date of Patent: Jun. 7, 1988

[54] DISPENSER FOR PASTE-LIKE SUBSTANCES

[75] Inventor: Klaus Derksen, Lohne/Oldb., Fed. Rep. of Germany

[73] Assignee: Bramlage Gesellschaft mit beschrankter Haftung, Fed. Rep. of Germany

[21] Appl. No.: 889,429

[22] Filed: Jul. 23, 1986

[30] Foreign Application Priority Data

Jun. 26, 1985 [DE] Fed. Rep. of Germany ..... 3526804

[51] Int. Cl.[4] ..... B67D 5/42

[52] U.S. Cl. ..... 222/80; 222/391; 222/541

[58] Field of Search ..... 222/80, 82, 173, 184, 222/386, 391, 478, 481, 541, 83, 207, 212, 387, 260

[56] References Cited

U.S. PATENT DOCUMENTS

| | | | |
|---|---|---|---|
| 2,829,801 | 4/1958 | Ayres | 222/82 |
| 3,255,935 | 6/1966 | Spatz | 222/391 X |
| 3,727,797 | 4/1973 | Cronan | 222/80 |
| 4,019,654 | 4/1977 | van Manen | 222/1 |
| 4,169,547 | 10/1979 | Newell | 222/386 |
| 4,413,759 | 11/1983 | Mettenbrink | 222/213 |
| 4,421,255 | 12/1983 | Czech | 222/391 X |
| 4,673,106 | 6/1987 | Fishman | 222/80 |
| 4,696,415 | 9/1987 | Meshberg | 222/82 |

FOREIGN PATENT DOCUMENTS 2,217,071 1/1974 Fed. Rep. of Germany.

*Primary Examiner*—Michael S. Huppert

*Attorney, Agent, or Firm*—Wood, Herron & Evans

[57] ABSTRACT

A dispenser for paste-like substances is disclosed having a piston which is slidably disposed in a dispenser housing. The piston moves as the dispenser is being emptied toward a dispensing opening while being restrained from movement in the opposite direction. A press button is connected with a rod that extends through the piston and is coupled nonpositively with the piston through the intermediary of a locking device permitting the rod to move freely in one direction, but to carry the piston in the opposite direction. A membrane seals the end of the housing opposite the discharge opening. The piston rod is designed as a piercing tool for piercing the membrane.

3 Claims, 2 Drawing Sheets

DISPENSER FOR PASTE-LIKE SUBSTANCES

BACKGROUND OF THE INVENTION

The present invention relates to dispensers for paste-like substances and is particularly directed to dispensers of the type having a piston movably mounted in the dispenser housing. As the dispenser is being emptied, the piston moves toward the discharge opening while it is restrained against movement in the opposite direction. A press button operating surface is provided on one end of the dispenser housing with a rod being coupled with the push button and extending through the piston. The rod is nonpositively coupled with the piston through the intermediary of the locking device, such that the rod can move freely through the piston in one direction, but carries the piston with it when moved in the opposite direction.

A dispenser of this type is disclosed in German patent disclosure No. 30 45 048. The bottom end closure in such prior art dispenser housing is formed by the piston. Long storage times give rise to the danger that the contents of the dispenser will dry out which may lead to difficulty in dispensing the remaining contents.

The principal object of the present invention is to provide a dispenser of the type described above with a simple means, in terms of manufacturing, which will prevent a drying or sticking of the contents even after extended periods of use, despite extreme climate conditions.

SUMMARY OF THE INVENTION

The present invention is predicated upon the concept of providing a sealing means for the bottom end of the dispenser housing comprising a membrane which extends across the housing and is protected by a bottom wall member. The end of the activating rod is configurated to form a piercing tool for piercing this membrane when the rod is activated. The bottom wall member extends across the dispenser housing outwardly of the membrane and includes a central opening for receiving the end of the rod after it has pierced the membrane.

In a preferred embodiment, the bottom wall is carried by a base ring which fits over the end of the housing.

One advantage of the present dispenser is that the bottom of the filled dispenser housing is effectively sealed. The shelf life is thereby maintained over an extended length of time. In this preferred embodiment, the membrane is formed by a foil which is impermeable to diffusion, the foil being sealed to the housing without using any adhesive. In order to avoid the generation of a vacuum, the destruction of the membrane is preferably accomplished by the piston rod which thus performs a second function, namely, that of a piercing tool. Since the head part of the housing which carries the press button is normally protected by a cap, there is no danger that the membrane will be pierced unintentionally. In the preferred embodiment, the membrane is mounted by means of a base ring slipped over the dispenser housing. Thus, the base ring preferably forms a protective bottom wall below the membrane and includes a pass-through opening which is aligned with the piston rod. The support of the membrane provided by the wall makes it possible to use an extremely thin foil since it is supported over almost its entire area by the bottom wall. Moreover, the membrane is clamped so that it cannot escape, thereby insuring the initial piercing that permits full movement of the rod.

These and other objects and advantages of the present invention will be more readily understood from the following description of a preferred embodiment of the invention.

BRIEF DESCRIPTION OF THE DRAWINGS

FIG. 2 is a bottom view of the dispenser housing before the base ring is slipped on.

DETAILED DESCRIPTION OF A PREFERRED EMBODIMENT

Figure 1:
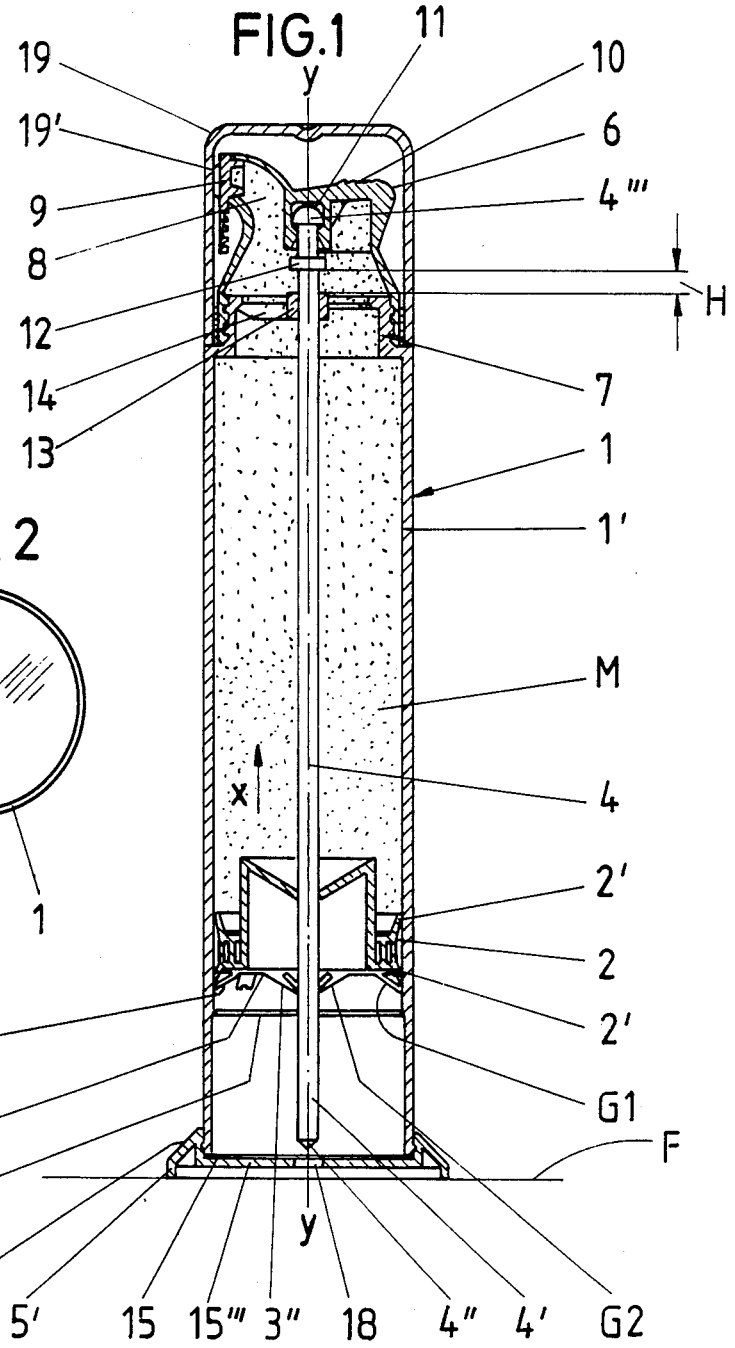
FIG. 1 is a vertical cross-sectional view of a preferred dispenser embodying the present invention.
Figure 2:
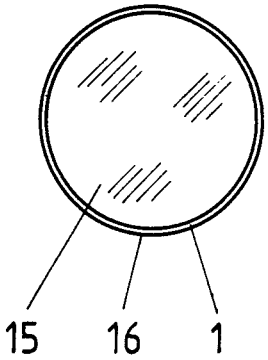

As shown in FIG. 1, in a preferred form of dispenser, the long cylindrical housing 1 of the dispenser contains the piston 2. The marginal lips 2' of the piston engage the cylindrical inside wall of the housing 1'.

The piston 2 can be moved exclusively in the dispensing direction (arrow x). It carries a first locking device G1 on its lower surface facing toward the bottom end of the housing. The locking device comprises a clamping module 3 in the form of a spring steel spider featuring prongs 3' which are radially arranged. The diameter of a circle circumscribing the spider prong ends is somewhat larger than the inside diameter of the dispenser housing 1, causing the prong ends to engage the housing inside wall 1' as inclined support feet locking opposite to the direction of arrow x.

The clamping module 3 also forms a second locking device G2 in the center. It interacts with a piston rod 4 which extends centrally through the piston 2. The prongs 3" of the clamping module 3 that point inward radially engage the piston rod 4. The pass-through opening left by the prongs 3", projected in a transverse plane, is smaller than the diameter of the piston rod 4.

The bottom end 4' of the piston rod 4 is pointed and is preferably in the shape of a cone 4'. Due to the non-positive coupling 62, a movement of the coupling rod in the direction of arrow x results in the entrainment of the piston 2. To accomplish this piston entrainment, the dispenser housing 1 carries an operating means on the end opposite the stand-up base of the housing which comprises a base ring 5. The operating means comprises a bellows-type head part 6 which can be collapsed in the direction of the piston 2 and will restore again to its home position. This head part is slipped on the offset and reduced neck 7 of the dispenser housing 1. Owing to its high elasticity, or flexibility, the head part is retained by way of a ring/groove engagement about the periphery of the neck so as to be stable in use. The head part includes a channel-type dispenser mouthpiece opening 8 having a reduced cross-section. Its design is that of a beak. Opening 8 is preferably circular and is situated in the vicinity of the extended direction of the housing wall. Opening 8 is sealed for storage with the aid of a tightly sealed plug 9. The plug is cup-shaped with the cup rim directed at the mouthpiece opening. This makes the plug highly flexible while optimizing the seal.

Head part 6 also includes on the back of the beak-type extension circumscribing the mouthpiece opening 8 a press button operating surface 10. In a preferred embodiment, surface 10 extends close to the opposite, imaginary extension of the housing wall and rises diagonally in the outward direction. Underneath this press button operating surface 10, a piston rod 4 is connected to head part 6. Rod 4 extends through the dispenser housing 1 along its longitudinal center axis y—y. Head part 6 is provided underneath the press button operating surface 10 with a locking recess 11 facing to the inside of the housing into which recess the upper end 4''', widened in mushroom fashion of rod 4, is snapped. To facilitate the snap-in connection, the locking recess 1 flairs on the piston side in the fashion of a funnel.

A short distance beneath the locking recess 11, piston rod 4 is provided with a collar-type bead 12 which limits the operating stroke H of the piston rod 4 by bearing on the upper end of a sleeve 13 in the neck 7 of the dispenser housing 1. The sleeve is connected with the neck 7 by means of spoke-type radial ribs 14. Sleeve 13, which functions as a guide for rod 4, is essentially flush with the top side of the neck end and protrudes downwardly about halfway into the neck opening.

While the top end of the dispenser is effectively sealed by the plug 9, a membrane 15 provides an airtight seal for the bottom area of the dispenser housing so that any drying or sticking of the paste-like substance is prevented. The membrane 15 can be connected with the lower edge 1'' of the dispenser housing by gluing, hot sealing or similar.

The membrane 15 is destroyed upon activation of the press-button operating surface 10. To accomplish this, the piston rod is designed as a piercing tool and preferably includes a point (cone 4'') at its end. The cone point is situated a distance z above the membrane 15 (see FIG. 3) which is smaller than the maximum stop-defined operating stroke of the piston rod 4. This will permit the rod to pierce the membrane creating a central opening which avoids the creation of a vacuum underneath the piston 2.

Figure 3:
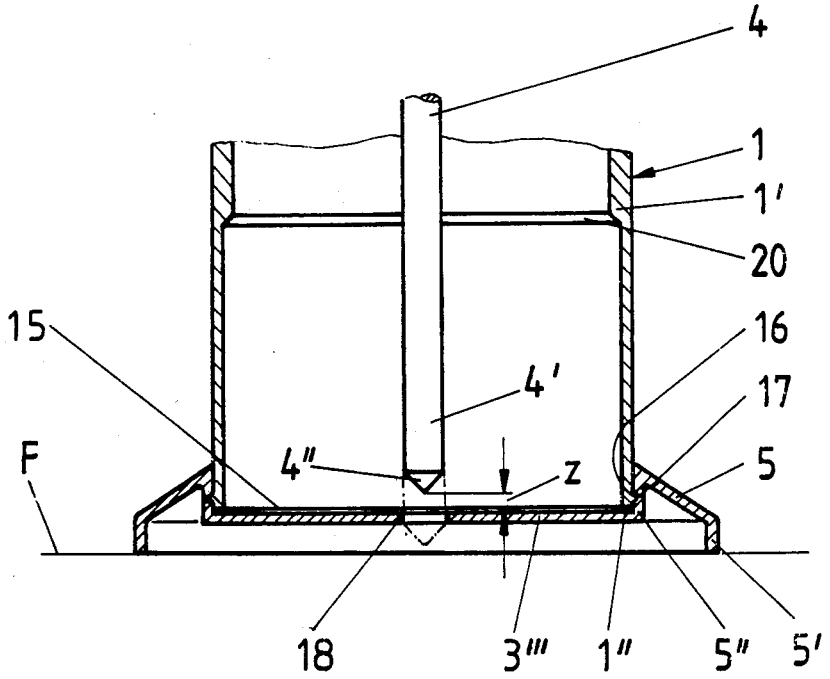
FIG. 3 is an enlarged end view similar to FIG. 1 of the bottom area of the dispenser.

As best shown in FIG. 3, the membrane 15 is mounted by means of the base ring 5 slipped on the dispenser housing. The base ring has the outside shape of a flat truncated cone. Directed downward, its cylindrical stand-up ring 5' provides a broadened stand-up surface for the dispenser and thus an enhanced stability. The ring is formed in the housing by forcing the base ring 5 over the end of the housing wall. In the preferred embodiment, a locking connection is provided to hold the ring and housing assembled. The outside surface of the cylindrical dispenser housing includes for that purpose a ring-shaped protrusion 16 for engaging a matching circular groove 17. The latter is located in cylindrical circular wall 5'' of the base ring. The lower portion of wall 5'' is joined to a horizontal bottom wall 15'''. The inside rim section of the latter is utilized for peripheral clamping attachment, while the bottom wall 15''' extending immediately below the membrane 15 supports the membrane from below.

Bottom wall 15''' is provided with a pass-through opening 18 aligned with rod 4 for receiving the piercing tool. The bottom wall 15''' extends at a vertical spacing from a support surface F, such that the point of the cone 4'' will not touch this surface. Thus, contents can be dispensed while the dispenser is standing up.

To avoid air from being trapped below the piston, the bottom end of the dispenser housing has an inside diameter which is greater than the longer residual section above it. These sections are joined by step 20.

The head part 6 is covered by a cap 19. The latter is held by a friction and form-fit on a peripheral bead disposed between the lower rim of head part 6 and the neck of the dispenser housing 1. The cylindrical inside wall 19' of the cap 19 functions to retain the plug 9 in its sealed position as a result of the engagement of the plug with this wall as shown in FIG. 1.

Briefly summarized, the functioning of the dispenser is as follows:

Upon removal of the cap 19 and pressing the operating surface 10 down, the pointed end of piston rod 4 pierces the membrane 15. As the operating surface is released, the clmaping module causes the piston 2 to be shifted upwardly in the direction of the mouthpiece, dispensing the pastelike substance as desired. Owing to the piercing of membrane 15, no vacuum can form below the piston. With appropriately restoring membrane material, the pierced hole will even close again in the fashion of a flap valve.

From the foregoing disclosure of the general principles of the present invention and the above description of a preferred embodiment, those skilled in the art will readily comprehend various modifications to which the invention is susceptible. Therefore, I desire to be limited only by the scope of the following claims.

Having described my invention, I claim:

1. A dispenser for paste-like substances comprising:
   - a housing having a discharge opening adjacent to a first end thereof;
   - a piston slidably disposed within said housing, said piston being effective to dispense said paste-like material when said piston is moved toward said discharge opening;
   - means restraining said piston from movement away from said discharge opening;
   - a push button mounted upon the first end of said housing;
   - said piston having an opening therethrough;
   - a rod extending through said opening in said piston;
   - means interconnecting said rod and said push button;
   - a locking device coupling said rod and said piston, whereby said rod can move relative to said piston in a direction away from said discharge opening, but said piston is moved with said rod when said rod is moved toward said discharge opening;
   - the end of said rod remote from said discharge opening being configured to form a piercing tool;
   - a membrane extending across and sealing the end of said dispenser housing remote from said discharge opening;
   - end wall means on said housing remote from said discharge opening covering said membrane, said end wall means having an opening aligned with said rod for receiving said rod, whereby said rod can pierce said membrane.

2. The dispenser of claim 1 further comprising a base ring mounting upon and surrounding the end of said housing remote from said dispenser opening, said base ring carrying said end wall means.

3. The dispenser of claim 2 in which said housing is cylindrical and said rod and said opening in said end wall means are disposed on the axis of said cylinder.

* * * * *